United States Patent [19]

Hinata et al.

[11] 4,010,037

[45] Mar. 1, 1977

[54] SPECTRALLY SENSITIZED SILVER HALIDE PHOTOGRAPHIC EMULSION

[75] Inventors: Masanao Hinata; Haruo Takei; Tadashi Ikeda; Mitsuo Iwamoto, all of Minami-ashigara, Japan

[73] Assignee: Fuji Photo Film Co., Ltd., Minami-ashigara, Japan

[22] Filed: Jan. 28, 1976

[21] Appl. No.: 653,995

Related U.S. Application Data

[63] Continuation of Ser. No. 530,125, Dec. 6, 1974, abandoned.

[30] Foreign Application Priority Data

Dec. 6, 1973 Japan ..... 48-138345

[52] U.S. Cl. ..... 96/100; 96/124

[51] Int. Cl.[2] ..... G03C 1/14

[58] Field of Search ..... 96/124, 100

[56] References Cited

UNITED STATES PATENTS

| | | | |
|---|---|---|---|
| 3,348,949 | 10/1967 | Bannert et al. | 96/124 |
| 3,856,532 | 12/1974 | Thurston et al. | 96/124 |

*Primary Examiner*—J. Travis Brown

*Attorney, Agent, or Firm*—Sughrue, Rothwell, Mion, Zinn & Macpeak

[57] ABSTRACT

A silver halide photographic emulsion containing, in combination, supersensitizing amounts of at least one sensitizing dye of the following general formula (I)

(I)

wherein $Z_1$ and $Z_2$ each represents an atomic group required for forming a benzimidazole ring; $R_1$ and $R_2$ each represents an aliphatic group and at least one of $R_1$ and $R_2$ represents an alkyl group having a carboxy group, a hydroxyalkyl group or an alkyl group having a sulfo group; $X_1$ represents an acid anion; and *m* is 1 or 2, *m* being 1 when the dye forms an inner salt (a betaine-like structure) and at least one sensitizing dye of the following general formula (II)

(II)

wherein $Z_3$ represents an atomic group required for forming a benzoxazole ring or a β-naphthoxazole ring; $Z_4$ represents an atomic group required for forming a benzothiazole ring, a benzoselenazole ring, a β-naphthothiazole ring or a β-naphthoselenazole ring; $R_3$ and $R_4$ each represents an aliphatic group and at least one of $R_3$ and $R_4$ represents an alkyl group having a carboxy group or an alkyl group having a sulfo group; $R_5$ represents a hydrogen atom or an alkyl group; $X_2$ represents an acid anion; and *n* is 1 or 2, *n* being 1 when the dye forms an inner salt.

12 Claims, 7 Drawing Figures

SPECTRALLY SENSITIZED SILVER HALIDE PHOTOGRAPHIC EMULSION

This is a continuation of application Ser. No. 530,125, filed Dec. 6, 1974, now abandoned.

BACKGROUND OF THE INVENTION

1. Field of the Invention

This invention relates to a silver halide photographic emulsion spectrally sensitized with at least two types of sensitizing dyes having a supersensitizing effect on each other and particularly, it relates to a silver halide photographic emulsion having an increased spectral sensitivity in the red-sensitive wavelength region.

2. Description of the Prior Art

It has been well known as one of the production techniques of photographic light-sensitive materials to broaden the light-sensitive wavelength region of a silver halide photographic emulsion toward the longer wavelength side, that is, subject the emulsion to spectral sensitization, by adding a certain cyanine dye to the emulsion.

It is also known that the spectral sensitivity is generally influenced by the chemical structure of the sensitizing dye added and various characteristics of the emulsion such as the halogen composition of the silver halides, the crystal habit, the crystal system, the silver ion concentration and the hydrogen ion concentration and also influenced by photographic additives present in the emulsion such as stabilizers, anti-fogging agents, coating aids, precipitating agents or color couplers.

For sensitization of a light-sensitive material in a predetermined spectral wavelength region, only one sensitizing dye is generally used. The combined use of sensitizing dyes often provides a spectral sensitivity lower than that obtained with the individual use of the sensitizing dyes. However, in special cases, a remarkable super-additive increase is obtained in spectral sensitivity when a sensitizing dye is used in combination with one or more other sensitizing dyes. This effect is known as supersensitization. However, a specific selection is required in combining the sensitizing dyes. Even a slight difference in the chemical structure significantly affects the supersensitizing effect, and therefore, it is difficult to predict which combination of sensitizing dyes will have a supersensitizing effect based only on the chemical structural formulas.

Moreover, the sensitizing effect on a particular emulsion can be generally varied by changes in the characteristics of the emulsion. For example, the sensitizing effect can be strengthened by increasing the silver ion concentration and/or decreasing the hydrogen ion concentration. Therefore, the sensitizing effect can be increased by immersing a film coated with a spectrally sensitized emulsion in water or an aqueous solution of ammonia. The above methods of changing the sensitivity of the spectrally sensitized emulsion by increasing the silver ion concentration and/or decreasing the hydrogen ion concentration are usually referred to as hypersensitization. The shelf life of hypersensitized emulsions is generally short.

When supersensitization is applied to a silver halide photographic emulsion, the sensitizing dyes used must not have adverse interactions with photographic additives other than the sensitizing dyes and stable photographic properties must be maintained during storage of the light-sensitive material.

Moreover, another requirement for the sensitizing dyes used is that "residual color" must not remain on the light-sensitive material due to the sensitizing dyes after processing. It is particularly required that no residual color is left after processing for a short time (usually several seconds to several tens of seconds) such as in rapid processing.

In order to obtain excellent color reproducibility in a color light-sensitive material, the red-sensitive layer preferably does not have a high sensitivity at too long a wavelength, for example, has a maximum sensitization at a wavelength longer than 660 nm and conversely, the red-sensitive layer preferably does not possess a sensitivity only in a too short wavelength region, for example, has a maximum sensitization at a wavelength shorter than 580 nm. Unfortunately, it is difficult with respect to spectral sensitization techniques to increase the sensitivity in the wavelength region where the maximum sensitization is situated below about 630 nm. Among all, it is particularly difficult to increase the sensitivity in the wavelength region ranging from 580 nm to 600 nm, and therefore, to solve this problem is one of the important subjects in the art.

SUMMARY OF THE INVENTION

Therefore, a first object of this invention is to provide a spectrally sensitized silver halide photographic emulsion which has a particularly high sensitivity in the wavelength region described above and with scarcely any residual color remaining after processing.

A second object of this invention is to provide a photographic emulsion for color light-sensitive materials, in which the decrease of the sensitivity generally occurring when a spectrally sensitizing dye and a cyan coupler are used in combination is reduced.

A third object of this invention is to provide a photographic emulsion for multi-layer light-sensitive materials, in which the adjacent light-sensitive layers are not sensitized due to the diffusion of a spectrally sensitizing dye.

A fourth object of this invention is to provide a photographic emulsion, in which the decrease of the sensitivity generally occurring during the passage of time from the production of the light-sensitive material is reduced.

The above objects are accomplished with a silver halide emulsion containing, in combination, supersensitizing amounts of at least one sensitizing dye of the following general formula (I)

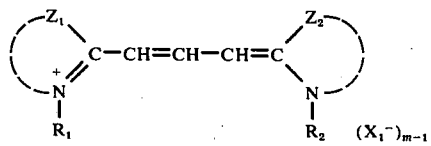

(I)

wherein $Z_1$ and $Z_2$ each represents an atomic group required for forming a benzimidazole ring, which ring may be substituted with substituents which do not deteriorate the sensitivity, etc., for example, halogen atoms such as chlorine or bromine; alkoxycarbonyl groups, e.g., having 1 to 4 carbon atoms in the alkyl moiety thereof such as methoxycarbonyl, ethoxycarbonyl or butoxycarbonyl; alkylcarbonyl groups, e.g., having 1 to 4 carbon atoms in the alkyl moiety thereof such as methylcarbonyl, etc.; $R_1$ and $R_2$ each represents an aliphatic group and at least one of $R_1$ and $R_2$ represents an alkyl group having a carboxy group, a hydroxyalkyl group or an alkyl group having a sulfo group; $X_1$ represents an acid anion; *m* is 1 or 2, with *m* being 1 when the dye forms an inner salt (a betaine-like structure);

and at least one sensitizing dye of the following general formula (II)

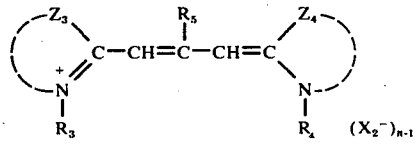

(II)

wherein $Z_3$ represents an atomic group required for forming a benzoxazole ring or a β-naphthoxazole ring, which may be substituted with substituents which do not deteriorate the sensitivity, etc., for example, alkyl groups, e.g., having 1 to 4 carbon atoms such as methyl, ethyl or trifluoromethyl; alkoxy groups, e.g., having 1 to 4 carbon atoms in the alkyl moiety thereof such as methoxy or ethoxy; acyl groups such as acetyl or benzoyl; halogen atoms such as chlorine or bromine; aryl groups such as phenyl; carbamoyl groups such as carbamoyl unsubstituted or substituted with alkyl groups, e.g., having 1 to 4 carbon atoms such as methyl or ethyl, etc.; $Z_4$ represents an atomic group required for forming a benzothiazole ring, a benzoselenazole ring, a β-naphthothiazole ring or a β-naphthoselenazole ring, which may be substituted with substituents which do not deteriorate the sensitivity, etc., for example, halogen atoms such as chlorine or bromine; alkyl groups, e.g., having 1 to 4 carbon atoms such as methyl or ethyl; alkoxy groups, e.g., having 1 to 4 carbon atoms in the alkyl moiety thereof such as methoxy or ethoxy; hydroxy groups; cyano groups; aryl groups such as phenyl; acyl groups such as acetyl or benzoyl; carbamoyl groups such as carbamoyl unsubstituted or substituted with alkyl groups, e.g., having 1 to 4 carbon atoms such as methyl or ethyl, etc.; $R_3$ and $R_4$ each represents an aliphatic group and at least one of $R_3$ and $R_4$ represents an alkyl group having a carboxy group or an alkyl group having a sulfo group; $R_5$ represents a hydrogen atom or an alkyl group; $X_2$ represents an acid anion; *n* is 1 or 2, with *n* being 1 when the dye forms an inner salt.

DETAILED DESCRIPTION OF THE INVENTION

Figure 1:
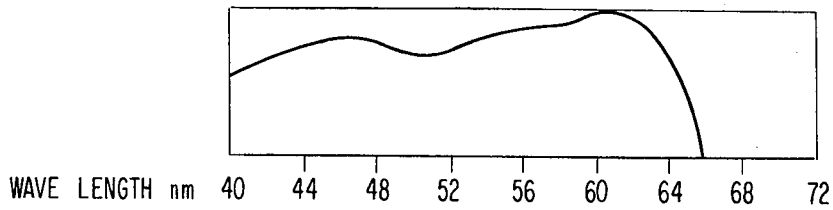
FIG. 1 to FIG. 6 show spectral sensitivity curves respectively obtained in Run Nos. 1, 2, 3, 6, 8 and 9 in the Example.

In the general formulas (I) and (II), the heterocyclic ring formed by $Z_1$ and the heterocyclic ring formed by $Z_2$ include, for example, benzimidazoles substituted in the 1-position with an alkyl group (e.g., an unsubstituted alkyl group such as methyl, ethyl or propyl, or an alkyl group substituted with a sulfo group or an acetoxy group), an allyl group, an aryl group (e.g., phenyl), or the like. Examples of these rings are 1-methyl-5-chlorobenzimidazole, 1-methyl-5-fluorobenzimidazole, 1-methyl-5,6-dichlorobenzimidazole, 1-methyl-5,6-difluorobenzimidazole, 1-ethyl-5-chlorobenzimidazole, 1-ethyl-5-fluorobenzimidazole, 1-ethyl-5,6-dichlorobenzimidazole, 1-ethyl-5,6-difluorobenzimidazole, 1-propyl-5-chlorobenzimidazole, 1-propyl-5-fluorobenzimidazole, 1-propyl-5,6-dichlorobenzimidazole, 1-propyl-5,6-difluorobenzimidazole, 1-allyl-5-chlorobenzimidazole, 1-allyl-5-fluorobenzimidazole, 1-allyl-5,6-dichlorobenzimidazole, 1-allyl-5,6-difluorobenzimidazole, 1-ethyl-5-butoxycarbonylbenzimidazole, 1-ethyl-5-methoxycarbonylbenzimidazole, 1-ethyl5-ethoxycarbonylbenzimidazole, 1-ethyl-5-methylcarbonylbenzimidazole, 1-phenyl-5-chlorobenzimidazole, 1-phenyl-5-fluorobenzimidazole, 1-phenyl-5,6-dichlorobenzimidazole and 1-phenyl-5,6-difluorobenzimidazole rings.

The heterocyclic ring formed by $Z_3$ includes, for example, benzoxazole, 5-methylbenzoxazole, 5-ethylbenzoxazole, 5-methoxybenzoxazole, 5-ethoxybenzoxazole, 5,6-dimethylbenzoxazole, 5,6-dimethoxybenzoxazole, 5-chlorobenzoxazole, 5-bromobenzoxazole, 5-trichloromethylbenzoxazole, 5-phenylbenzoxazole and β-naphthoxazole rings.

The heterocyclic ring formed by $Z_4$ includes, for example, benzothiazole, 5-chlorobenzothiazole, 5-bromobenzothiazole, 5-methylbenzothiazole, 5-ethylbenzothiazole, 5-methoxybenzothiazole, 5-methoxycarbonylbenzothiazole, 5-ethoxycarbonylbenzothiazole, 5-phenylbenzothiazole, 5-cyanobenzothiazole, 5-hydroxybenzothiazole, β-naphthothiazole, benzoselenazole, 5-chlorobenzoselenazole, 5-bromobenzoselenazole, 5-methylbenzoselenazole, 5-methoxybenzoselenazole, 5-phenylbenzoselenazole, and β-naphthoselenazole rings.

Examples of alkyl groups for $R_5$ are those, e.g., having 1 to 4 carbon atoms such as a methyl, ethyl and propyl group.

$R_1$, $R_2$, $R_3$ and $R_4$ each represents an unsubstituted alkyl group, e.g., having 1 to 4 carbon atoms such as a methyl, ethyl or propyl group; or a substituted alkyl group, e.g., having 1 to 8 carbon atoms and having 1 to 4 carbon atoms in the alkyl moiety such as a hydroxyalkyl group (e.g., a 2-hydroxyethyl group, a 3-hydroxypropyl group), an alkyl group having a carboxy group (e.g., a carboxyalkyl group such as a 2-carboxyethyl group, a 3-carboxypropyl group or a 4-carboxybutyl group), a carboxyalkoxyalkyl group (e.g., a 2-(2-carboxyethoxy)ethyl group), an alkyl group having a sulfo group (e.g., a sulfoalkyl group such as a 2-sulfoethyl, a 3-sulfopropyl or a 3-sulfobutyl group), a sulfo-alkoxy-substituted alkyl group (e.g., a 2-(3-sulfopropoxy)ethyl group, a 3-sulfopropoxyethoxyethyl group), or a sulfohydroxy-substituted alkyl group (e.g., a 2-hydroxy-3-sulfopropyl group).

$X_1$ and $X_2$ each represents an acid anion used for conventional cyanine dye salts such as a iodide, bromide, chloride, p-toluenesulfonate, benzenesulfonate, sulfate, perchlorate or thiocyanate ion.

With regard to the chemical structure, the sensitizing dyes represented by the general formula (I) can be characterized as an imidacarbocyanine containing a hydroxyalkyl group, an alkyl group having a carboxy group or an alkyl group having a sulfo group as a substituent attached to the nitrogen atom of one of the nitrogen-containing heterocyclic rings, preferably on both rings, and preferably have a maximum sensitization in a wavelength region of about 570 to 585 nm. With regard to the chemical structure, the sensitizing dyes represented by the general formula (II) can be characterized as nonsymmetrical carbocyanine dyes containing a hydroxyalkyl group, an alkyl group having a carboxy group or an alkyl group having a sulfo group on the nitrogen atom of the nitrogen-containing heterocyclic ring, and preferably have a maximum sensitization in a wavelength region of about 590 to 610 nm. The combined use of the sensitizing dye of the general formula (I) and the sensitizing dye of the general formula (II) remarkably increases the sensitivity in the wavelength region (particularly, ranging from about 580 to 600 nm) in which the sensitizing dye of the general formula (II) has a spectrally sensitizing effect.

The supersensitizing technique according to this invention is useful for the production of emulsions for multi-layers incorporated-coupler color light-sensitive materials, particularly reversal color light-sensitive materials and negative color light-sensitive materials, and emulsions for microfilm negative light-sensitive materials.

Specific examples of the sensitizing dyes which can be used in this invention are given below. However, this invention is not to be construed as being limited to these examples only. Specific examples of the sensitizing dyes represented by the general formula (I) are as follows.

(I-A)

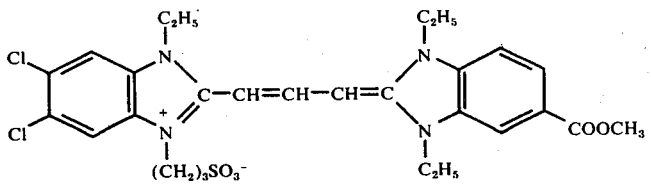

(I-B)

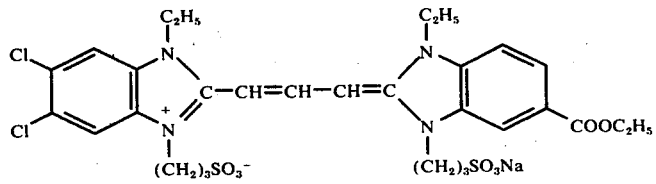

(I-C)

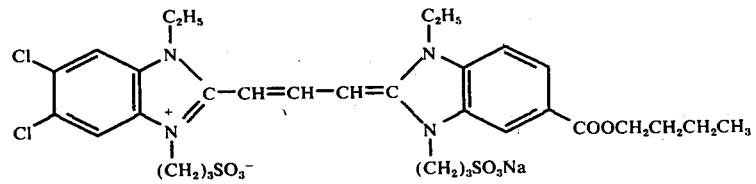

(I-D)

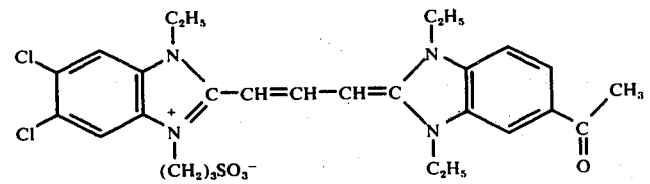

(I-E)

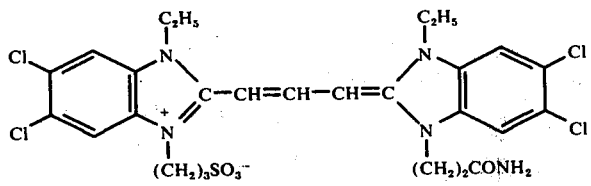

(I-F)

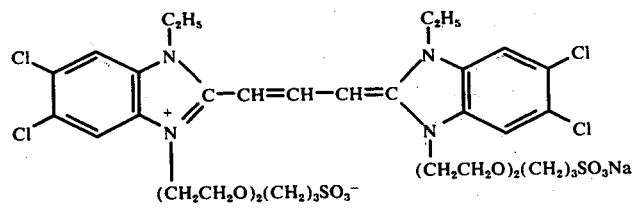

(I-G)

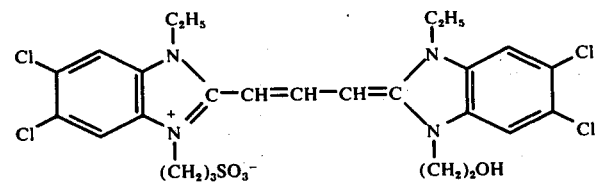

-continued
(I-H)
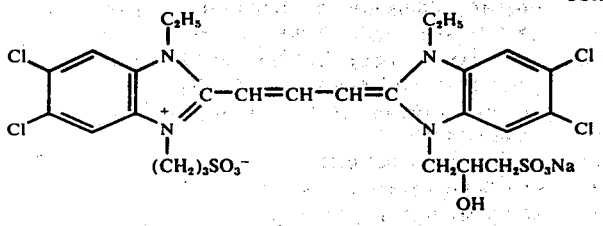
Specific examples of the sensitizing dyes represented by the general formula (II) are as follows.
(II-A)
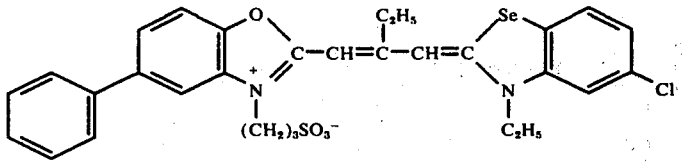
(II-B)
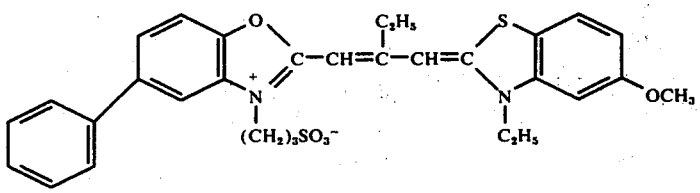
(II-C)
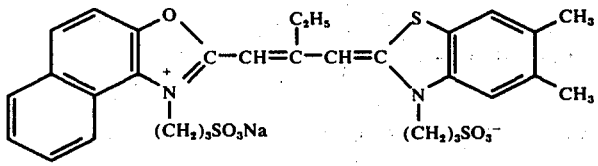
(II-D)
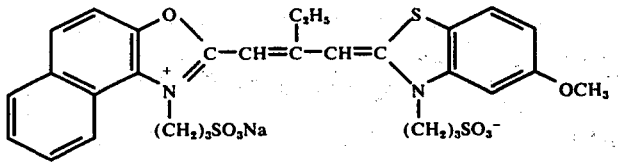
(II-E)
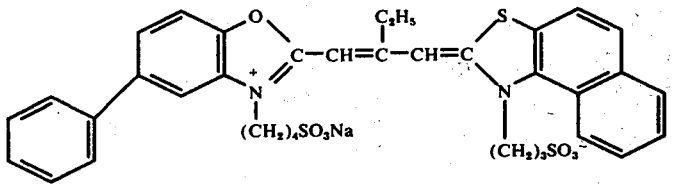
(II-F)
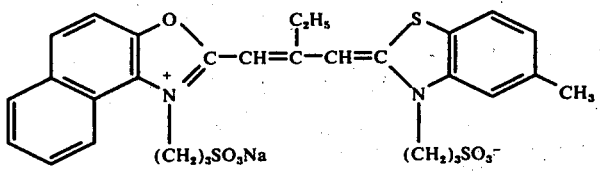
(II-G)
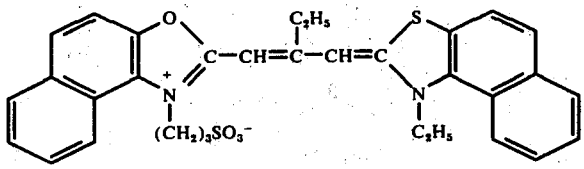

-continued

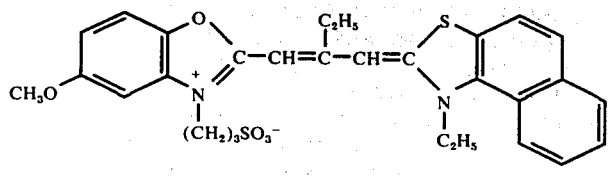

(II-H)

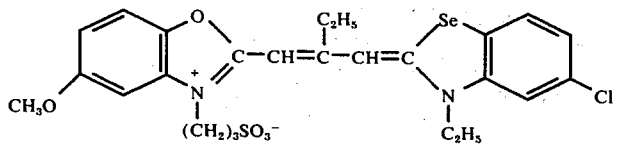

(II-I)

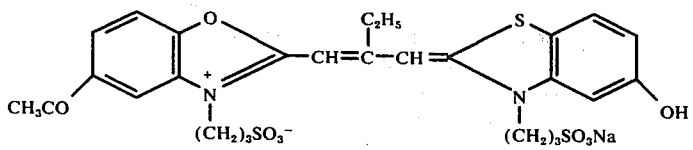

(II-J)

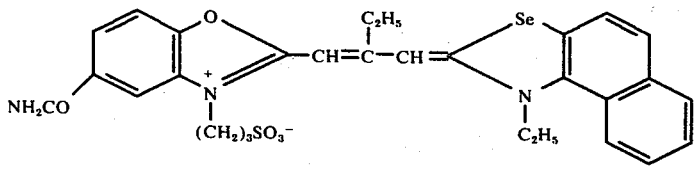

(II-K)

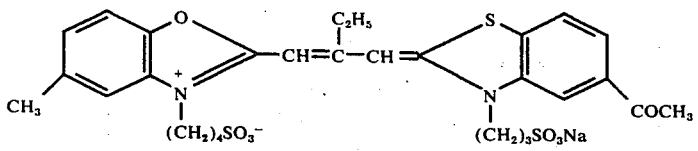

(II-L)

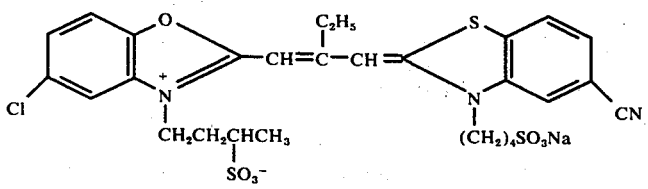

(II-M)

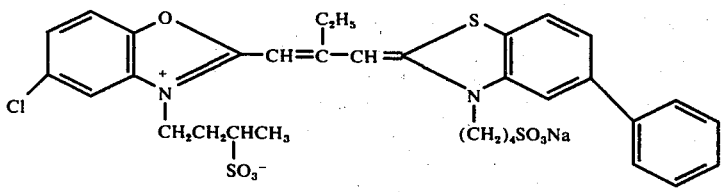

(II-N)

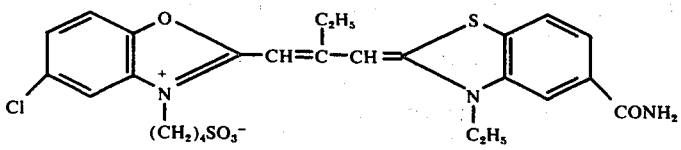

(II-O)

The silver halide used for the emulsion of this invention can be prepared using conventional techniques, for example, precipitated by the single jet method or the double jet method or by using a combination thereof and ripened. The silver halide can be silver chloride, silver bromide, silver iodide or mixed silver halide grains. A preferred silver halide is silver bromoiodide or silver chlorobromoiodide which preferably has an iodide content of about 10 mol% or less. The silver halide can be either a usual grain size or a fine grain size, but the average diameter of the grains (e.g., as measured by the projected area method and expressed as a number average) is preferably about 0.04 to 2 microns.

The silver halide photographic emulsion used in this invention can be subjected to usual chemical sensitizing methods, for example, gold sensitization (as disclosed in U.S. Pat. Nos. 2,540,085; 2,597,856; 2,597,915 and 2,399,083), Group VIII metal ion sensitization, sulfur sensitization (as disclosed in U.S. Pat. Nos. 1,574,944; 2,278,947; 2,440,206; 2,410,689; 3,189,458 and 3,415,649), reduction sensitization (as disclosed in U.S. Pat. Nos. 2,518,698; 2,419,974 and 2,983,610) or a combination of these sensitization methods.

Specific examples of chemical sensitizers are sulfur sensitizers such as allylthiocarbamide, thiourea, sodium thiosulfate or cystine; noble metal sensitizers such as potassium chloroaurate, aurous thiosulfate or potassium chloropalladate; and reduction sensitizers such as stannous chloride, phenylhydrazine or reductone. Other sensitizers such as polyoxyethylene compounds, polyoxypropylene compounds or compounds with a quaternary ammonium group can be also used. Furthermore, an antifoggant such as nitrobenzimidazole or ammonium chloroplatinate and a stabilizer such as 4-hydroxy-6-methyl-1,3,3a,7-tetrazaindene can be employed in the emulsion of this invention.

Moreover, a hardening agent such as formaldehyde, chromalum, 1-hydroxy-3,5-dichlorotriazine sodium salt, glyoxal or dichloroacrolein and a coating aid such as saponin or a sodium alkylbenzenesulfonate can be employed.

The silver halide emulsion used in this invention can contain a color coupler and a dispersing agent therefor when used for light-sensitive materials for color photography. Of the color couplers, a cyan coupler is particularly preferred. For example, the phenolic couplers as described in U.S. Pat. No. 2,698,794 and the naphtholic couplers as described in U.S. Pat. No. 2,474,293 are particularly useful. Also, the couplers as described in U.S. Pat. Nos. 2,600,788 and 3,062,653 and Japanese Patent Publication No. 6,031/65 and the $\alpha$-naphtholic cyan couplers and the phenolic cyan couplers as described in U.S. Pat. Nos. 3,311,476; 3,458,315; 3,214,437 and 3,253,924 can be used.

Typical examples of colored couplers are those described in the following patent specifications: Japanese Patent Publication No. 2,016/69, U.S. patent application Ser. No. 462,842, filed Apr. 22, 1974, U.S. Pat. Nos. 3,476,560; 3,034,892; 3,386,301; 2,434,272 and 3,476,564.

Typical examples of DIR couplers which can be used are those described in U.S. Pat. Nos. 3,148,062; 3,227,554; 3,701,783; 3,617,291, 3,622,328, 3,790,384 and 3,770,436 and Japanese patent application No. 33,233/70.

The silver halide photographic emulsion used in this invention can contain, as a protective colloid, gelatin and acylated gelatin such as phthalated gelatin or malonated gelatin; cellulose compounds such as hydroxyethyl cellulose or carboxymethyl cellulose; soluble starches such as dextrin; and hydrophilic polymers such as polyvinyl alcohol, polyvinyl pyrrolidone, polyacrylamide or polystyrenesulfonic acid, and a plasticizer for dimensional stabilization, a latex polymer and a matting agent. The finished emulsion can be coated onto a suitable support, for example, baryta paper, resin-coated paper, synthetic paper, triacetate film, polyethylene terephthalate film, glass sheet or other plastic bases. A suitable coating amount of the silver halide emulsion on the support can range from about $10^{-3}$ mol to $10^{-1}$ mol of silver halide per $m^2$ of the support.

The sensitizing dyes used in this invention can be added in the form of an aqueous solution or a solution in a water-miscible organic solvent such as methanol, ethanol, methyl cellosolve or pyridine. The amount added is a conventional supersensitizing amount, for example, about $5 \times 10^{-3}$ mol to $1 \times 10^{-6}$ mol of each sensitizing dye per mole of silver. The molar ratio of the dye of the general formula (II) to the dye of the general formula (I) is preferably about 1:10 to 10:1.

The combination of the dyes used in this invention, which has a supersensitizing effect, is applicable for the sensitization of various silver halide photographic emulsions for color light-sensitive materials and black-and-white light-sensitive materials. Such emulsions are, for example, emulsions for color positive light-sensitive materials, emulsions for color papers, emulsions for color negative light-sensitive materials, emulsions for color reversal light-sensitive materials (with or without couplers), emulsions for photographic light-sensitive materials for the graphic arts (such as lith films), emulsions used for light-sensitive materials for recording the display of cathode ray tubes, emulsions used for X-ray recording light-sensitive materials (particularly, light-sensitive materials for direct or indirect photography using an intensifying screen), emulsions used for the colloid transfer process (as described, for example, in U.S. Pat. No. 2,716,059), emulsions used for the silver salt diffusion transfer process (as described, for example, in U.S. Pat. Nos. 2,352,014; 2,543,181; 3,020,155 and 2,861,885), emulsions used for the color diffusion transfer process (as described, for example, in U.S. Pat. Nos. 3,087,817; 3,185,567; 2,983,606; 3,253,915; 3,227,550; 3,227,551; 3,227,552; 3,415,644; 3,415,645 and 3,415,646), emulsions used for the dye transfer process (the imbibition transfer process) (as described, for example, in U.S. Pat. No. 2,882,156), emulsions used for the silver-dye bleach process as described, for example, in Friedman, *History of Color Photography*, particularly Chapter 24, American Photographic Publishers Co., (1944) and *British Journal of Photography*, Vol. III, pp. 308 ~ 309, Apr. 7, (1964)), emulsions used for light-sensitive materials for recording print out images (as described, for example, in U.S. Pat. No. 2,369,449 and Belgian Pat. No. 704,255), emulsions used for printing-out light-sensitive materials (as described, for example, in U.S. Pat. Nos. 3,033,682 and 3,287,137), emulsions used for light-sensitive materials for thermal development (as described, for example, in U.S. Pat. Nos. 3,152,904; 3,312,550 and 3,148,122, and British Pat. No. 1,110,046), and emulsions used for light-sensitive materials for physical development (as described, for example, in British Pat. Nos. 920,277 and 1,131,238).

Moreover, the dyes used in this invention can be applied for spectral sensitization according to the techniques as described in German Patent Laid-Open Application No. 2,104,283 or U.S. Pat. No. 3,649,286.

The following example is given in order to illustrate this invention in greater detail without limiting the same. Unless otherwise indicated, all parts, percents, ratios and the like are by weight.

EXAMPLE

A silver bromoiodide emulsion having an iodide content of 7 mol% was obtained by precipitating silver halide grains using the conventional double jet method and subjecting the same to physical ripening using a conventional method as described in P. Glafkides, *Chimie et Physique Photographiques*, pp. 367 ~ 443 (1957), desalting treatment and then chemical ripening. The average diameter of the silver halide grains contained in this emulsion was 0.42 microns. This emulsion contained 0.52 mols of silver halide per 1 kg of the emulsion.

1 kg of the emulsion was placed in a pot and heated in a constant temperature bath at 50° C to melt the emulsion.

Predetermined amounts as shown in Table 1 of methanol solutions of each of the sensitizing dyes of this invention and comparative sensitizing dyes were respectively added to the emulsion and mixed with stirring at 40° C.

10 cc of a 0.1% by weight aqueous solution of 4-hydroxy-6-methyl-1,3,3a,7-tetrazaindene was added, 10 cc of a 1% by weight aqueous solution of 1-hydroxy-3,5-dichlorotriazine sodium salt was added and further 10 cc of a 1% by weight aqueous solution of sodium dodecylbenzenesulfonate was added and then the emulsion were stirred.

Each of the finished emulsions was coated onto a cellulose triacetate film base so as to provide a dry film thickness of 5 microns and then dried, thus preparing samples of a light-sensitive material. Each of the film samples was cut into strips.

One of the strips was subjected to optical wedge exposure using a sensitometer with a light source of a color temperature of 5400° K through a blue filter (Sp-1) or a red filter (Sc-56) manufactured by the Fuji Photo Film Co., Ltd., which filters were respectively attached to the light source.

Another strip was exposed to obtain a spectrogram using a diffraction grating type spectrograph with a tungsten light source of a color temperature of 2666° K.

A further strip was subjected to optical wedge exposure to determine the sensitivity for monochromatic light having a wavelength of 580 nm using a Shimazu-Boschrom intensive monochrometer of a diffraction grating type (manufactured by Shimazu Seisakusho Ltd.).

The sampe was developed at 20° C for 2 minutes using a developer having the following composition, stopped, fixed and washed with water to obtain a strip having a predetermined black-and-white image. The strip was then subjected to density measurement using an S-type densitometer manufactured by the Fuji Photo Film Co., Ltd. to obtain a blue filter sensitivity (SB), a red filter sensitivity (SR), a sensitivity for monochromatic light of a wavelength of 580 nm (S 580) and fog. The standard point of the optical density to determine the sensitivity was fog + 0.2.

| Developer Composition | |
|---|---|
| Water | 500 ml |
| Metol | 2.2 g |
| Sodium Sulfite (anhydrous) | 96.0 g |
| Hydroquinone | 8.8 g |
| Sodium Carbonate (monohydrate) | 56.0 g |
| Potassium Bromide | 5.0 g |
| Water | to 1 l |

The results obtained are shown in Table 1 to Table 5 as relative values.

The effects caused by the combined use of the sensitizing dyes according to this invention is not deteriorated at all when a known red-sensitizing dye is further combined, that is, when the combination of the sensitizing dyes (I) and (II) is used in combination with a known red-sensitive sensitizing dye.

The red-sensitive dyes which can be used in combination with the sensitizing dyes used in this invention are represented, for example, by the following general formula (III).

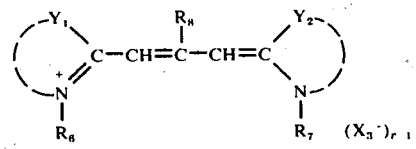

(III)

wherein $Y_1$ and $Y_2$ each represents an atomic group required for forming a benzothiazole ring, a benzoselenazole ring or a naphthothiazole ring, which may be substituted with substituents which do not deteriorate the sensitivity, or the like, for example, those described for the aforementioned general formulas (I) and (II); $R_6$ and $R_7$ each represents an aliphatic group, for example, those described for the aforementioned general formulas (I) and (II) and at least one of them is preferably an alkyl group having a sulfo group, an alkyl group having a carboxy group or a hydroxyalkyl group; $R_8$ represents a lower alkyl group such as methyl or ethyl, or an aryl group such as phenyl; $X_3$ and $r$ have the same meanings as $X_1$ and $m$ in the general formula (I), respectively.

Specific examples of the red-sensitive sensitizing dyes are as follows.

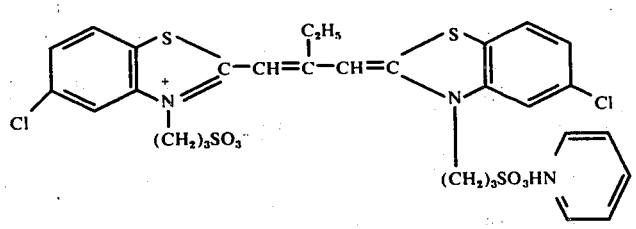

(A)

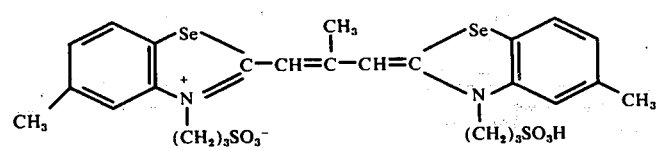

(B)

-continued (C)

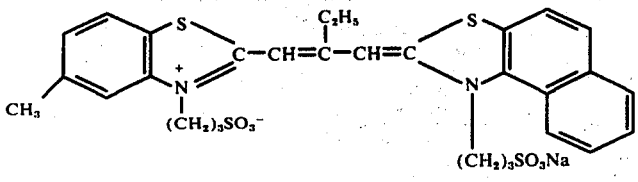

(D)

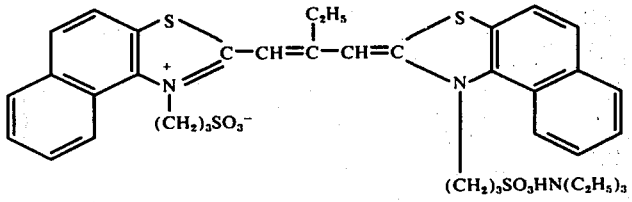

(E)

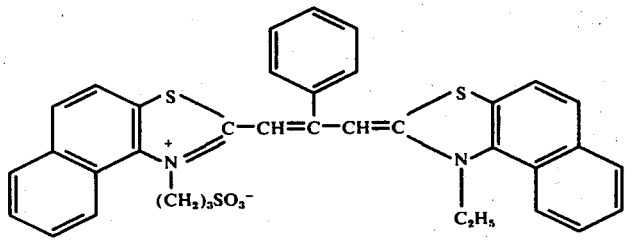

TABLE 1

Figure 2:
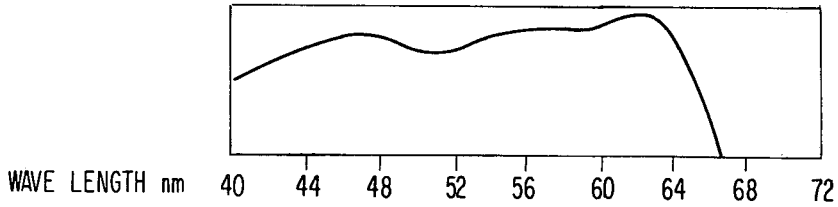
Figure 3:
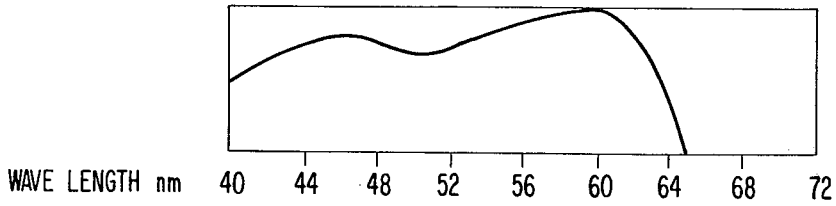
Figure 4:
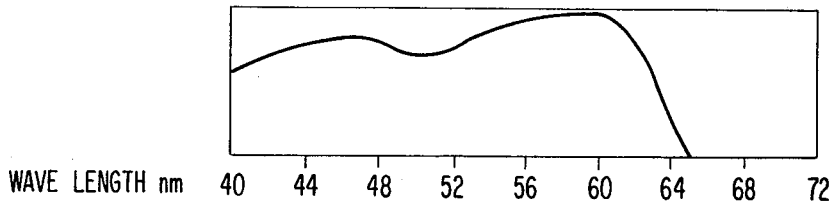
Figure 5:
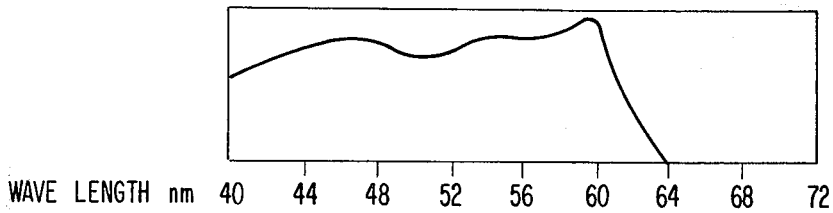
Figure 6:
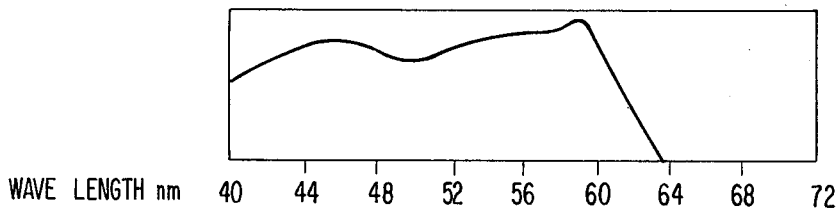
Figure 7:
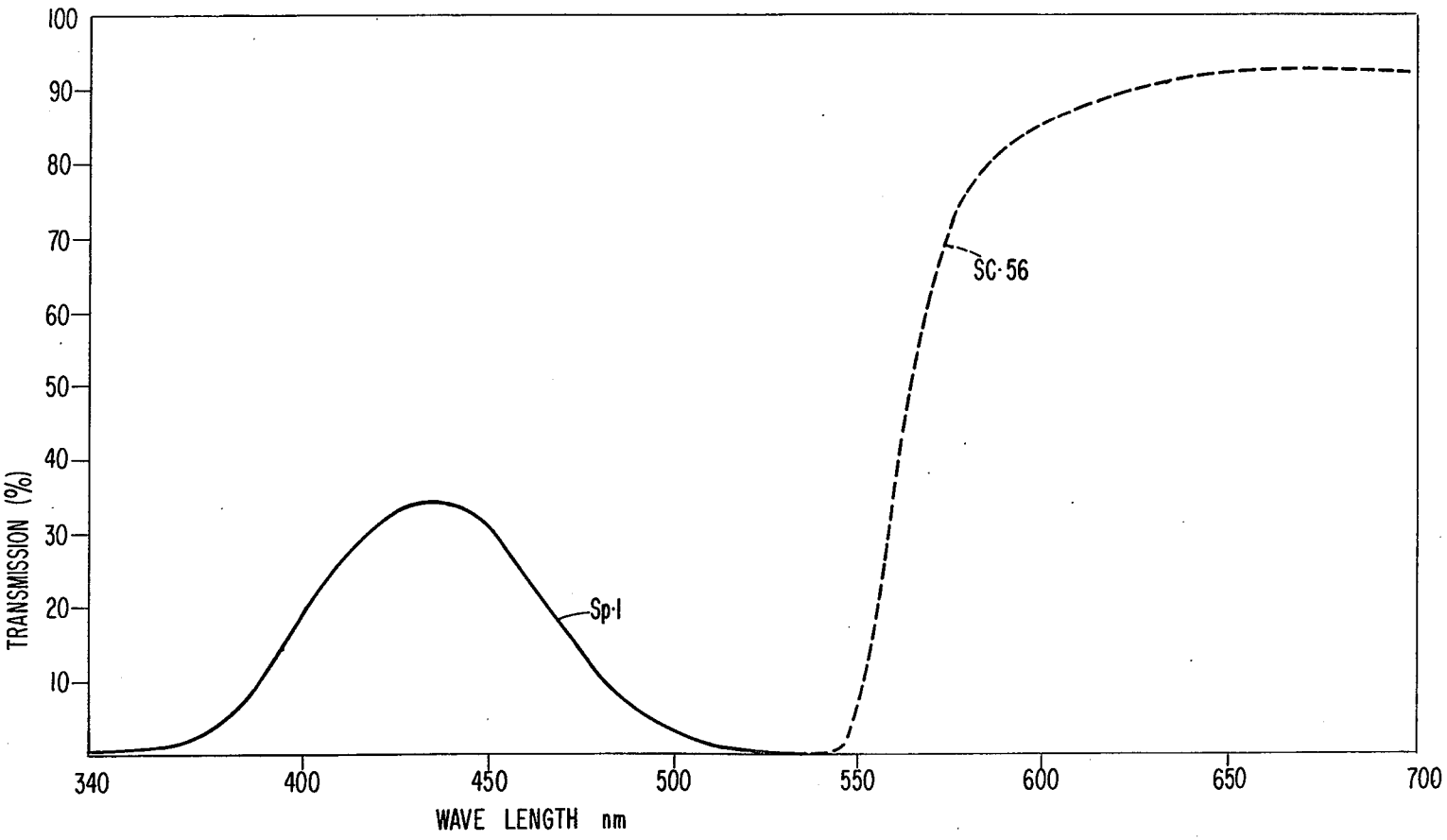
FIG. 7 shows spectral transmittance curves of the filters Sp-1 and Sc-56 used in the Example.

| Run No. | Sensitizing Dye and Amount Added (× $10^{-5}$ mol) | | | | | SR | SB | Fog | Residual Color ** | Spectrogram |
|---|---|---|---|---|---|---|---|---|---|---|
| 1 | — | | — | | — | * | 100 | 0.05 | None | |
| | (I-F) | 2 | — | | — | 69 | 100 | 0.05 | None | |
| | | 4 | — | | — | 100 | 100 | 0.05 | None | |
| | — | | (II-D) | 4 | — | 145 | 84 | 0.05 | None | |
| | — | | | 8 | — | 212 | 61 | 0.06 | None | |
| | (I-F) | 2 | (II-D) | 4 | — | 232 | 100 | 0.05 | None | |
| | | 2 | | 8 | — | 240 | 84 | 0.06 | None | FIG. 1 |
| 2 | (I-F) | 2 | (II-D) | 8 | (A) 2 | 256 | 84 | 0.07 | Very little | FIG. 2 |
| 3 | — | | (II-F) | 4 | — | 204 | 96 | 0.05 | None | |
| | — | | | 8 | — | 265 | 84 | 0.06 | None | |
| | (I-F) | 2 | (II-F) | 4 | — | 232 | 100 | 0.06 | None | |
| | | 4 | | 4 | — | 256 | 84 | 0.06 | None | |
| | | 2 | | 8 | — | 270 | 90 | 0.06 | None | FIG. 3 |
| 4 | (I-F) | 2 | (II-F) | 8 | (E) 2 | 274 | 70 | 0.07 | very little | |
| 5 | (I-F) | 2 | (II-F) | 8 | (A) 2 | 290 | 84 | 0.07 | Very little | |
| 6 | (I-A) | 2 | — | | — | 55 | 90 | 0.05 | None | |
| | | 4 | — | | — | 81 | 70 | 0.05 | None | |
| | (I-A) | 4 | (II-F) | 4 | — | 230 | 76 | 0.06 | None | FIG. 4 |
| | | 4 | | 8 | — | 290 | 64 | 0.06 | None | |
| 7 | — | | (II-A) | 4 | — | 240 | 115 | 0.05 | None | |
| | — | | | 8 | — | 290 | 115 | 0.05 | None | |
| | (I-A) | 4 | (II-A) | 4 | — | 270 | 87 | 0.05 | None | |
| | | 4 | | 8 | — | 320 | 81 | 0.05 | None | |
| 8 | (I-B) | 2 | — | | — | 93 | 93 | 0.05 | None | |
| | | 4 | — | | — | 115 | 81 | 0.05 | None | |
| | (I-B) | 2 | (II-A) | 8 | — | 350 | 90 | 0.05 | None | |
| | | 4 | | 8 | — | 350 | 81 | 0.05 | None | FIG. 5 |
| 9 | (I-C) | 2 | — | | — | 85 | 97 | 0.05 | None | |
| | | 4 | — | | — | 119 | 73 | 0.05 | None | |
| | — | | (II-B) | 4 | — | 186 | 93 | 0.05 | None | |
| | — | | | 8 | — | 269 | 93 | 0.05 | None | |
| | (I-C) | 4 | (II-B) | 4 | — | 260 | 97 | 0.05 | None | |
| | | 4 | | 8 | — | 320 | 90 | 0.05 | None | FIG. 6 |
| 10 | — | | (II-G) | 4 | — | 162 | 79 | 0.05 | None | |
| | — | | | 8 | — | 223 | 76 | 0.07 | Very little | |
| | (I-A) | 4 | (II-G) | 4 | — | 240 | 87 | 0.06 | None | |
| | | 4 | | 8 | — | 250 | 69 | 0.07 | Very little | |
| 11 | (I-F) | 2 | (II-G) | 8 | — | 260 | 81 | 0.07 | Very little | |
| | | 4 | | 4 | — | 216 | 73 | 0.06 | None | |

*Too low and impossible to measure.
** Residual color: little > very little > none

TABLE 2

| Sensitizing Dye and Amount Added (× $10^{-5}$ mol) | | | | S 580 | Fog |
|---|---|---|---|---|---|
| (I-A) | 2 | — | | 78 | 0.05 |
| | 4 | — | | 85 | 0.05 |
| — | | (II-A) | 4 | 81 | 0.05 |
| — | | | 8 | 100 | 0.05 |
| (I-A) | 4 | (II-A) | 4 | 134 | 0.05 |
| | 4 | | 8 | 134 | 0.05 |

TABLE 3

| Sensitizing Dye and Amount Added (× $10^{-5}$ mol) | | S 580 | Fog |
|---|---|---|---|
| (I-D) 4 | — | 100 | 0.05 |
| — | (II-F) 4 | 89 | 0.05 |
| (I-D) 4 | (II-F) 4 | 110 | 0.05 |

TABLE 4

| Sensitizing Dye and Amount Added (× $10^{-5}$ mol) | | | | S 580 | Fog |
|---|---|---|---|---|---|
| (I-A) | 4 | — | | 80 | 0.05 |
| — | | (II-F) | 4 | 70 | 0.05 |
| — | | | 8 | 100 | 0.06 |
| (I-A) | 4 | (II-F) | 4 | 115 | 0.06 |
| | 4 | | 8 | 115 | 0.06 |

TABLE 5

| Sensitizing Dye and Amount Added (× $10^{-5}$ mol) | | | | S 580 | Fog |
|---|---|---|---|---|---|
| (I-B) | 2 | — | | 100 | 0.05 |
| | 4 | — | | 100 | 0.05 |
| — | | (II-A) | 8 | 91 | 0.05 |
| (I-B) | 2 | (II-A) | 8 | 111 | 0.05 |
| | 4 | | 8 | 111 | 0.05 |

As is apparent from the results obtained, it can be understood that excellent effects are obtained by the combination of the dyes represented by the general formulas (I) and (II) having a supersensitizing effect according to this invention.

That is, the combined use of the sensitizing dyes represented by the general formulas (I) and (II) provides a supersensitizing effect and remarkably increases the sensitivity in the red wavelength region (up to about 630 nm). In the red wavelength region, the increase in the sensitivity is seen even for monochromatic light of a wavelength of 580 nm at the short wavelength side, the residual color is observed to be very little, if at all, and fog is less.

The combination of the sensitizing dyes represented by the general formulas (I) and (II) having a supersensitizing effect according to this invention is useful for spectral sensitization of silver halide emulsions used for red-sensitive layers of color light-sensitive materials such as color negative light-sensitive materials or color reversal light-sensitive materials, spectral sensitization of silver halide emulsions used for lithographic light-sensitive materials, and spectral sensitization of silver halide emulsions used for light-sensitive materials for microsecond exposure, particularly, CRT light-sensitive materials, light-sensitive materials for holography and light-sensitive materials for facsimile systems.

When the above combination according to this invention is used for color light-sensitive materials, a magenta or red external filter layer is preferably placed above or adjacent a red-sensitive silver halide emulsion layer prepared according to this invention so that the relative reduction of the green sensitivity to the red sensitivity is brought about practically. For forming the filter layer, the dyes as described, for example, in Japanese Patent Publication Nos. 18,459/66, 3,504/68, 13,168/68 and 22,069/64; Japanese patent application No. 98,474/71, and U.S. Pat. Nos. 3,440,051; 3,468,883; 3,294,539; 3,379,533; 3,352,680; 3,389,994; 3,384,487; 3,423,207; 3,493,375; 3,486,897; 3,540,887; 3,615,546; 3,481,927; 3,497,502; 3,573,289; 3,560,214, 3,615,432 and 3,282,699, and British Pat. No. 506,385 can be used. Particularly useful are those dyes which have a selective absorption in the short wavelength region below 570 nm. The methods as described, for example, in U.S. Pat. Nos. 3,425,834; 3,469,987; 3,455,693; 3,392,022; 3,282,699; 3,502,474; 3,512,983; 3,445,231 and 3,672,898 and Belgian Pat. No. 627,308 can also be used. They are also used for anti-irradiation or antihalation.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing, in combination, supersensitizing amounts of at least one sensitizing dye of the following general formula (I)

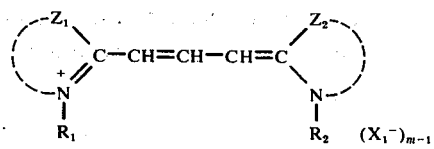

(I)

wherein $Z_1$ and $Z_2$ each represents an atomic group required for forming a benzimidazole ring and the ring formed by $Z_2$ or the ring formed by $Z_1$ is substituted in the 5-position with a chlorine atom, a methoxycarbonyl group, an ethoxycarbonyl group, a propoxycarbonyl group, a butoxycarbonyl group, a methylcarbonyl group or an ethylcarbonyl group; $R_1$ and $R_2$ each represents an aliphatic group and at least one of $R_1$ and $R_2$ represents an alkyl group having a sulfo group; $X_1$ represents an acid anion; and $m$ is 1 or 2, and when $m$ is 1 the dye forms an inner salt;

and at least one sensitizing dye of the following general formula (II)

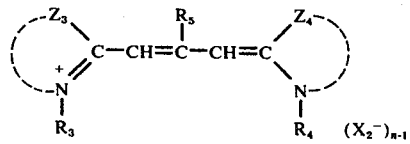

(II)

wherein $Z_3$ represents an atomic group required for forming a benzoxazole ring or a β-naphthoxazole ring; $Z_4$ represents an atomic group required for forming a benzothiazole ring, a benzoselenazole ring, a β-naphtholthiazole ring or a β-naphthoselenazole ring; $R_3$ and $R_4$ represents an alkyl group having a carboxy group or an alkyl group having a sulfo group; $R_5$ represents a hydrogen atom or an alkyl group; $X_2$ represents an acid anion; and $n$ is 1 or 2, and when $n$ is 1 the dye forms an inner salt.

2. The silver halide photographic emulsion of claim 1, wherein the heterocyclic ring formed by $Z_1$ and the heterocyclic ring formed by $Z_2$ is a benzimidazole ring substituted in the 5- and 6-positions with at least one chlorine atom.

3. The silver halide photographic emulsion of claim 1, wherein the heterocyclic ring formed by $Z_3$ represents an unsubstituted benzoxazole ring, a benzoxazole ring substituted in the 5-position with a methyl group, a methoxy group, a chlorine atom or a phenyl group, or a $\beta$-naphthoxazole ring, and $R_5$ represents an ethyl group.

4. The silver halide photographic emulsion of claim 1, wherein the heterocyclic ring formed by $Z_4$ represents an unsubstituted benzothiazole ring, a benzothiazole ring substituted in the 5-position with a methyl group, a methoxy group, a chlorine atom or a phenyl group, or a $\beta$-naphthothiazole ring, and $R_5$ represents an ethyl group.

5. The silver halide photographic emulsion of claim 1, wherein the heterocyclic ring formed by $Z_4$ represents an unsubstituted benzoselenazole ring, a benzoselenazole ring substituted in the 5-position with a methyl group, a methoxy group, a chlorine atom or a phenyl, or a $\beta$-naphthoselenazole ring, and $R_5$ represents an ethyl group.

6. The silver halide photographic emulsion of claim 1, wherein at least one of $R_1$ and $R_2$ represents a sulfoalkyl group, a carboxyalkyl group or a hydroxyalkyl group.

7. The silver halide photographic emulsion of claim 1, wherein at least one of $R_3$ and $R_4$ represents a sulfoalkyl group or a carboxyalkyl group.

8. The silver halide emulsion of claim 1 wherein the benzimidazole rings formed by $Z_1$ and $Z_2$ are each substituted in the 5-position with a chlorine atom.

9. The silver halide photographic emulsion of claim 1, including a color coupler.

10. The silver halide photographic emulsion of claim 1, wherein the heterocyclic ring formed by $Z_3$ represents an unsubstituted benzoxazole ring, a benzoxazole ring substituted in the 5-position with a methyl group, a methoxy group, a chlorine atom or a phenyl group, or a $\beta$-naphthoxazole ring, the heterocyclic ring formed by $Z_4$ represents an unsubstituted benzothiazole ring, a benzothiazole ring substituted in the 5-position with a methyl group, a methoxy group, a chlorine atom or a phenyl group, or a $\beta$-naphthothiazole ring, and $R_5$ represents an ethyl group.

11. The silver halide photographic emulsion of claim 1, wherein the heterocyclic ring formed by $Z_3$ represents an unsubstituted benzoxazole ring, a benzoxazole ring substituted in the 5-position with a methyl group, a methoxy group, a chlorine atom or a phenyl group, or a $\beta$-naphthoxazole ring, the heterocyclic ring formed by $Z_4$ represents an unsubstituted benzoselenazole ring, a benzoselenazole ring substituted in the 5-position with a methyl group, a methoxy group, a chlorine atom or a phenyl group, or a $\beta$-naphthoselenazole ring, and $R_5$ represents an ethyl group.

12. A photographic material comprising a support having thereon the silver halide photographic emulsion of claim 1.

* * * * *